United States Patent [19]

Scott

[11] Patent Number: 4,901,686

[45] Date of Patent: Feb. 20, 1990

[54] ENGINE HEATING ASSEMBLY

[75] Inventor: Ian J. C. Scott, Madison Heights, Mich.

[73] Assignee: Chrysler Motors Corporation, Highland Park, Mich.

[21] Appl. No.: 354,601

[22] Filed: May 22, 1989

[51] Int. Cl.[4] ..... F02N 17/02

[52] U.S. Cl. ..... 123/142.5 E; 219/306; 219/307; 219/318

[58] Field of Search ..... 123/142.5 E; 219/306, 219/307, 318, 208

[56] References Cited

U.S. PATENT DOCUMENTS

| | | | |
|---|---|---|---|
| 2,712,589 | 7/1955 | Piermattoe | 219/318 |
| 3,229,065 | 1/1966 | Kerl et al. | 219/208 |
| 3,646,314 | 2/1972 | Windsor | 123/142.5 E |
| 3,979,574 | 9/1976 | Rynard | 123/142.5 E |
| 4,175,229 | 11/1979 | Brinkhof et al. | 123/142.5 E |
| 4,242,564 | 12/1980 | Kendall | 123/142.5 E |
| 4,286,139 | 8/1981 | Taylor | 123/142.5 E |
| 4,465,039 | 8/1984 | Snelgrove et al. | 123/142.5 E |

*Primary Examiner*—E. Rollins Cross

*Attorney, Agent, or Firm*—Kenneth H. MacLean, Jr.

[57] ABSTRACT

For use with a liquid cooled engine with a freeze plug opening, a heater assembly with a resistance type heating element supported in the interior of a generally cup-shaped housing with an open end positioned over the freeze plug opening.

7 Claims, 1 Drawing Sheet

ENGINE HEATING ASSEMBLY

BACKGROUND OF THE INVENTION

Engine coolant heaters are commonly used during winter in the colder parts of the country. The heater maintains a vehicle engine warmer than without the heater overnight and thus provides easier starting and faster warmup.

A typical heater uses an electrical resistance element mounted mostly to one side of a circular base. The base is attached to the exterior of an engine block over an opening connected to a coolant passage of the engine. All liquid cooled engine blocks have several of these openings which are covered by circular plates or freeze plugs. If the engine coolant freezes and expands, the freeze plugs are designed to be pushed out of the opening and thus relieve the expansive pressure and prevent block cracking.

The typical heater element has two parallel legs connected by a return bend portion. Also, the legs are bent or curved so that the return bend portion and a substantial portion of the legs are inserted through and past the block opening and actually into the coolant passage. This works well as long as the coolant passage is wide enough to allow the heating element to enter. However, it is known that many modern engines do not have wide enough coolant passages.

SUMMARY OF THE INVENTION

As previously stated, many engines do not have wide enough passages to allow use of the above described heater assembly. A good example of this is the Chrysler Motors family of four cylinder engines typically mounted transversely in an engine compartment. It so happens that only one of the coolant passages at the rearward facing side of the engine are wide enough to accept the conventional heater. No other passages of the engine are wide enough. Unfortunately, it is inconvenient to mount a heater at the back side because the intake and exhaust manifolds block easy access and the routing of the wire to power the heater is difficult. Therefore, a heater on the relatively clear forward side of the engine is desirable.

The subject coolant heater was developed to allow use on an engine independently of the width or dimension of the associated coolant passage. An unbent heater element is mounted in the interior of an elongated heater housing. The housing has an open end portion for cooperating with the block opening and a closed end wall which supports the heater element. A fastener and associated clamp member allow the installer to secure the heater assembly to the block after the freeze plug is removed. Seal means are utilized about the housing to inhibit leakage.

Further advantageous features of the subject heater assembly will be more readily apparent from a reading of the following detailed description of a preferred embodiment.

IN THE DRAWINGS

FIG. 1 is a perspective view of a mounted heater assembly; and

FIG. 2 is a sectioned view taken along section line 2—2 in FIG. 1 and looking in the direction of the arrows; and FIG. 3 is sectioned view taken along section line 3—3 in FIG. 2 and looking in the direction of the arrows; and FIG. 4 is a sectioned view taken along section line 4—4 in FIG. 2 and looking in the direction of the arrows.

DESCRIPTION OF A PREFERRED EMBODIMENT

Figure 1:
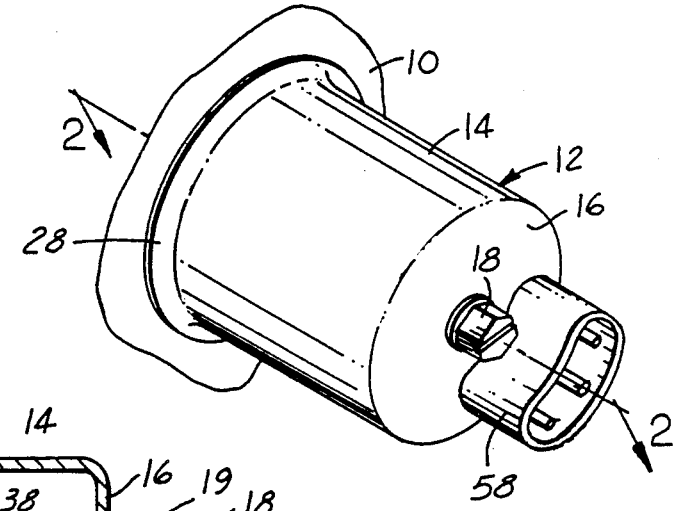

With respect to the drawings and specifically FIG. 1, a portion of an engine block 10 is illustrated. Attached to block 10 is a heater assembly 12 which is for the purpose of warming coolant in the block so that the engine can be more easily started in colder weather. The heater 12 comprises a thin walled housing with a generally cylindrical side wall 14 and an end wall 16. In FIG. 1, the head of a fastener 18 is illustrated. As will be more obvious from the following explanation, the fastener 18 attaches the heater 12 to the exterior of the block 10. An O-ring type seal member 19 is positioned between the fastener head and the end wall 16.

Figure 2:
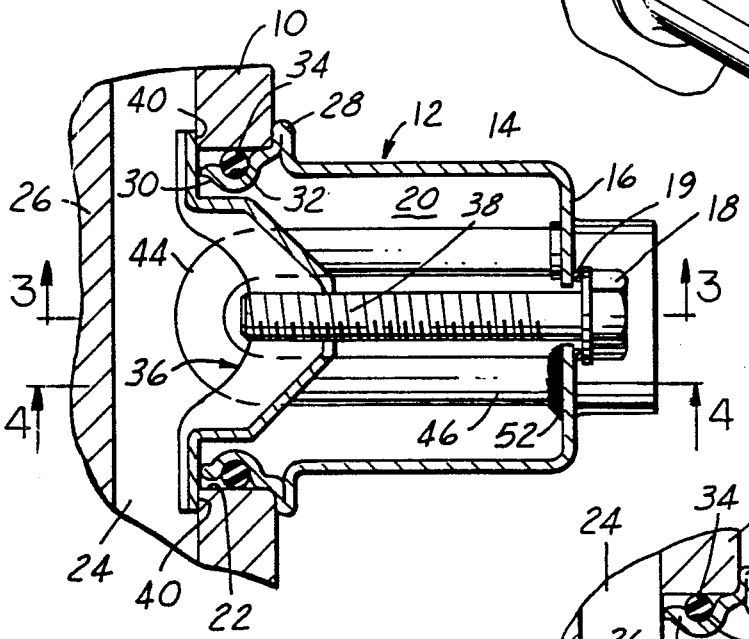
Figure 3:
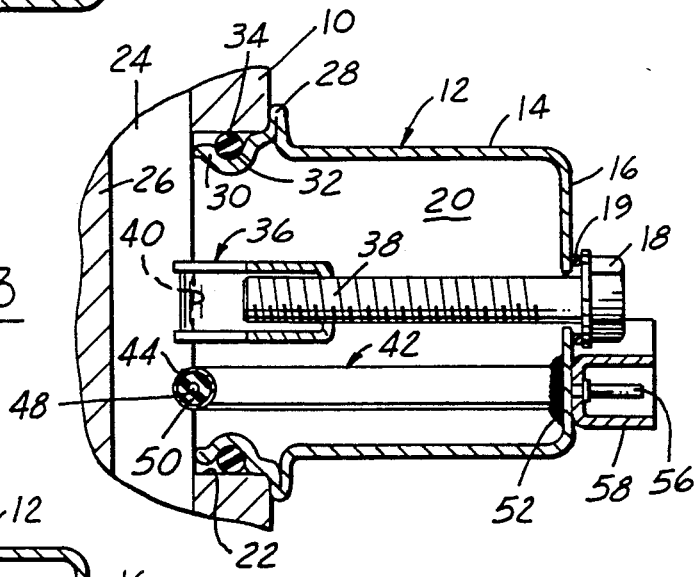
Figure 4:
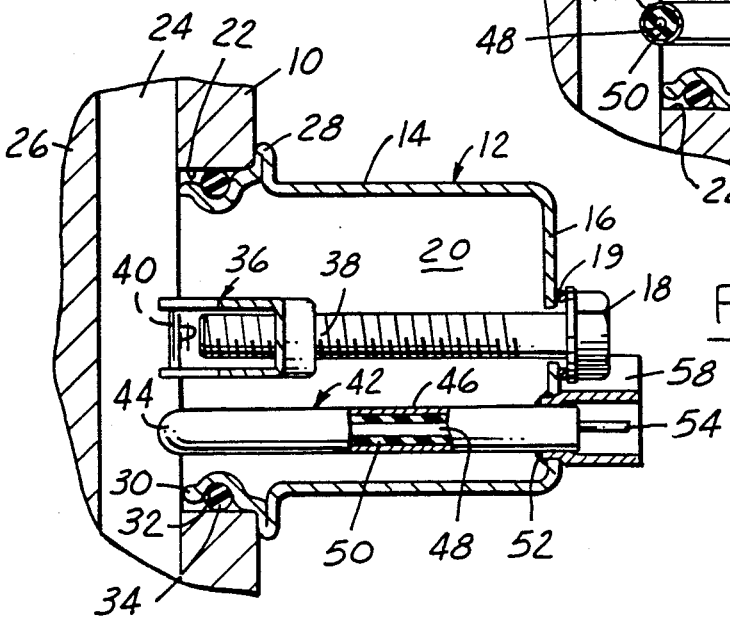

For more details of the heater structure, reference is made to FIGS. 2–4. Therein, an interior space 20 of the thin walled housing is shown. The interior 20 is partially defined by the side wall 14 and the end wall 16. Opposite the end wall 16, the heater housing has an open end which is where the housing is mounted to the block. The interior 20 is fluidly communicated with engine coolant through the open end as is explained below.

A circular opening 22 in engine block 10 extends from an interior coolant passage 24 to the block's exterior. As illustrated in FIGS. 2–4, the coolant passage 24 is defined on the interior by a block wall portion 26 and on the exterior by block wall portion 10. Between block portions 10 and 26, the width of passage 24 is relatively narrow and does not present very much space for inserting a coolant heater.

As previously stated, the heater assembly 12 is attached to the engine block by fastener 18. The side wall 14 of the housing has a radially outwardly extending annular or collar portion 28 formed therein. Collar 28 acts as a shoulder which in association with the exterior of the block 10 positions the heater housing against leftward movement produced by fastener 18.

Obviously, it is desirable to prevent leakage of coolant from either passage 24 or housing 14. To this end, an edge 30 of the side wall 14 is inserted into the opening 22 when the heater 12 is attached to the block 10. Edge 30 also defines the open end of the housing which allows fluid communication with the coolant passage 24. A radially inwardly directed channel shaped formation 32 is formed in the side wall 14 adjacent the edge 30. Channel 32 supports an annularly shaped O-ring 34 whose outer surface sealingly engages the surface defining the opening 22.

There has been a previous reference to fastener 18 which attaches the heater 12 to the block 10. The fastener 18 threadably engages a saddle clamp member 36 within the housing interior 20. Specifically, a threaded end portion 38 of fastener 18 extends through a central portion of the saddle clamp 36 in a threadably adjustable manner. Opposite end portions 40 of the saddle clamp 36 engage edge portions of the block outward from the opening 22. The ends 40 of the clamp 36 are located further to the left than the central portion of the clamp so that the clamp has a self-centering capacity. Accordingly, rotation of the fastener 18 in one direction moves the heater housing and positions the collar 28 against the exterior surface of the block 10.

The heater assembly 12 supports an electrical resistance heating assembly 42 within the interior 20. Assembly 42 generally is U-shaped with a return bend portion 44 integrally connecting two parallel leg portions 46. The structure of the assembly 42 itself includes a central wire heating element 48 covered by electrical insulation 50. An outer metallic skin or cover, preferably of copper, encircles the element 48 and insulation 50. The cover actually contacts the coolant in the interior 20.

As best shown in FIG. 4, the rightward end of one leg 46 of the resistance member extends through end wall 16. The cover of the resistance member is attached to the heater by a solder or braze connection 52. An end 54 of the central wire heating element is exposed and extends externally from the insulation 50 and cover portion of the assembly 42. The exposed end 54 serves as a terminal so that electricity may be transmitted to the element. The other leg of the element 42 is similarly extended through end wall 16. In addition, a ground terminal 56 extends away from the housing as seen in FIG. 3.

In the preferred embodiment shown in the drawings, the above described terminals 54 and 56 are encircled by the side wall of an open ended plug receptacle 58. As best shown in FIG. 4, the receptacle 58 has portions encircling the legs 46 and extending through the end wall 16. The solder or braze joint 52 connects the cover of resistance member 42, the end wall 16 and the receptacle 58.

Although only a single embodiment of the invention has been illustrated and described in detail above, it is easily understood that modifications to the invention can be made which will still fall within the scope of the following claims which describe the invention.

What is claimed:

1. For use with an engine block having an interior passage for liquid coolant and having a freeze plug opening in the block connected to the coolant passage, an improved coolant heater assembly covering the opening to selectively warm the engine coolant, comprising: a cup-shaped and thin walled heater housing having an interior space open at one end and closed at an opposite end, the housing being adapted to have its open end aligned with the opening in the block thereby allowing coolant to pass into the housing interior; an electrical resistance type heating element extending through the interior and having a pair of spaced end portions extending through the closed end of the housing; externally exposed end portions of the heating element outside of the housing defining terminals for selective application of electrical energy whenever coolant heating is desired; an elongated saddle clamp member of sufficient length to be positioned across the opening in the block with its ends engaging edges thereof adjacent the opening, the clamp having a centrally threaded opening; an elongated fastener extending through the closed end of the housing and the interior into threaded engagement with the saddle clamp, thereby securing the housing to the block.

2. For use with an engine block having an interior passage for liquid coolant and having a freeze plug opening in the block connected to the coolant passage, an improved coolant heater assembly covering the opening to selectively warm the engine coolant, comprising: a thin walled heater housing including an end wall and a side wall which define an interior space, the housing having an open end opposite the end wall whereby the housing is adapted to be positioned relative to the block so that the open end is aligned with the opening in the block to allow coolant to flow into the housing interior; a generally U-shaped electrical resistance type heating element having two spaced leg portions integrally connected by 35 a return bend portion within the interior, ends of the leg portions extending through the end wall; terminal portions extending from the end portions externally of the housing for selective applications of electrical energy to the element whenever warming of the coolant is desired; an elongated saddle clamp member of sufficient length to be positioned across the opening in the block with end portions thereof engaging the edges of the block about the opening, the saddle clamp having a threaded opening through its central portion, an elongated fastener extending through the end wall of the housing and the interior into threaded engagement with the saddle clamp to secure the housing to the block.

3. The improved heater assembly as set forth in claim 1 or 2 having a radially outwardly extending annular collar formed adjacent the open end thereby defining a shoulder adapted to engage the exterior surface of the block for positioning the housing with respect to the block.

4. The improved heater assembly set forth in claim 3 and having an annular channel formed in the housing adjacent the collar and positioned so that engagement of the collar with the external surface of the block places the channel within the block opening; an annular seal member in the channel so that it engages portions of the block forming the opening to inhibit coolant leakage therebetween.

5. The improved heater assembly set forth in claims 1 or 2 in which the elongated fastener extends loosely through the housing so that the fastener and attached saddle clamp can be pivoted relative to the housing axis so that the ends of the saddle clamp can be inserted through the opening in the block prior to rotating the fastener and thus drawing the open end of the housing toward the block.

6. The improved heater assembly set forth in claims 1 or 2 in which the heating element has a central wire element for carrying electricity, an insulator about the central wire element and an outer metallic cover; the cover extending through the housing and being fastened thereto in a conductive manner such as by either soldering or brazing.

7. The improved heater assembly set forth in claim 6 in which the ends of the wire element are exposed at a position external to the housing so that terminals are formed thereby for receiving electricity; a receptacle member having a side wall encircling the terminals and defining an open end for access to the terminals thereby protecting the terminals.

* * * * *